US006715941B2

(12) United States Patent
Scodellaro et al.

(10) Patent No.: US 6,715,941 B2
(45) Date of Patent: Apr. 6, 2004

(54) DEVICE FOR THE WET CHEMICAL PROCESSING OF PHOTOGRAPHIC MATERIAL

(75) Inventors: Eni Scodellaro, Gaio di Spilimbergo (IT); Franco Fracas, Cordenons (IT)

(73) Assignee: Gretag Imaging Trading AG, Wettingen (CH)

( * ) Notice: Subject to any disclaimer, the term of this patent is extended or adjusted under 35 U.S.C. 154(b) by 0 days.

(21) Appl. No.: 10/259,378

(22) Filed: Sep. 30, 2002

(65) Prior Publication Data

US 2003/0049033 A1 Mar. 13, 2003

Related U.S. Application Data

(63) Continuation of application No. PCT/EP00/02824, filed on Mar. 30, 2000.

(51) Int. Cl.[7] ..... G03D 3/02; G03D 13/00

(52) U.S. Cl. ..... 396/568; 396/578; 396/626; 396/630

(58) Field of Search ..... 396/626, 567–570, 396/578, 636, 617, 620, 622, 630; 355/27–29, 40, 41; 134/64 P, 64 R, 122 P, 122 R

(56) References Cited

U.S. PATENT DOCUMENTS

| | | | |
|---|---|---|---|
| 3,779,147 | A | 12/1973 | Woollacott |
| 3,990,088 | A | 11/1976 | Takita |
| 4,057,818 | A | 11/1977 | Gaskell et al. |
| 5,307,107 | A | 4/1994 | Nozawa et al. |

FOREIGN PATENT DOCUMENTS

| | | |
|---|---|---|
| EP | 0809148 A1 | 11/1997 |
| WO | WO0175521 | 3/2000 |

*Primary Examiner*—D Rutledge
(74) *Attorney, Agent, or Firm*—Burns, Doane, Swecker & Mathis, L.L.P.

(57) ABSTRACT

A processor for photographic material includes a multitude of treatment tanks through which the photographic material to be treated is sequentially moved and in which photographic treatment solutions are found during operation, especially developing, bleaching, fixing and stabilizing solutions. The processor includes a refill pump and conduit system for pumping the treatment solutions and the water used from storage containers for treatment solutions and a water tank into the treatment tanks. A refill pump and a corresponding refill conduit is provided for each storage container and the water tank. A control for the refill pumps cooperates with level sensors associated with the storage containers in such a way that the refill process is stopped when one of the storage containers is empty.

11 Claims, 1 Drawing Sheet

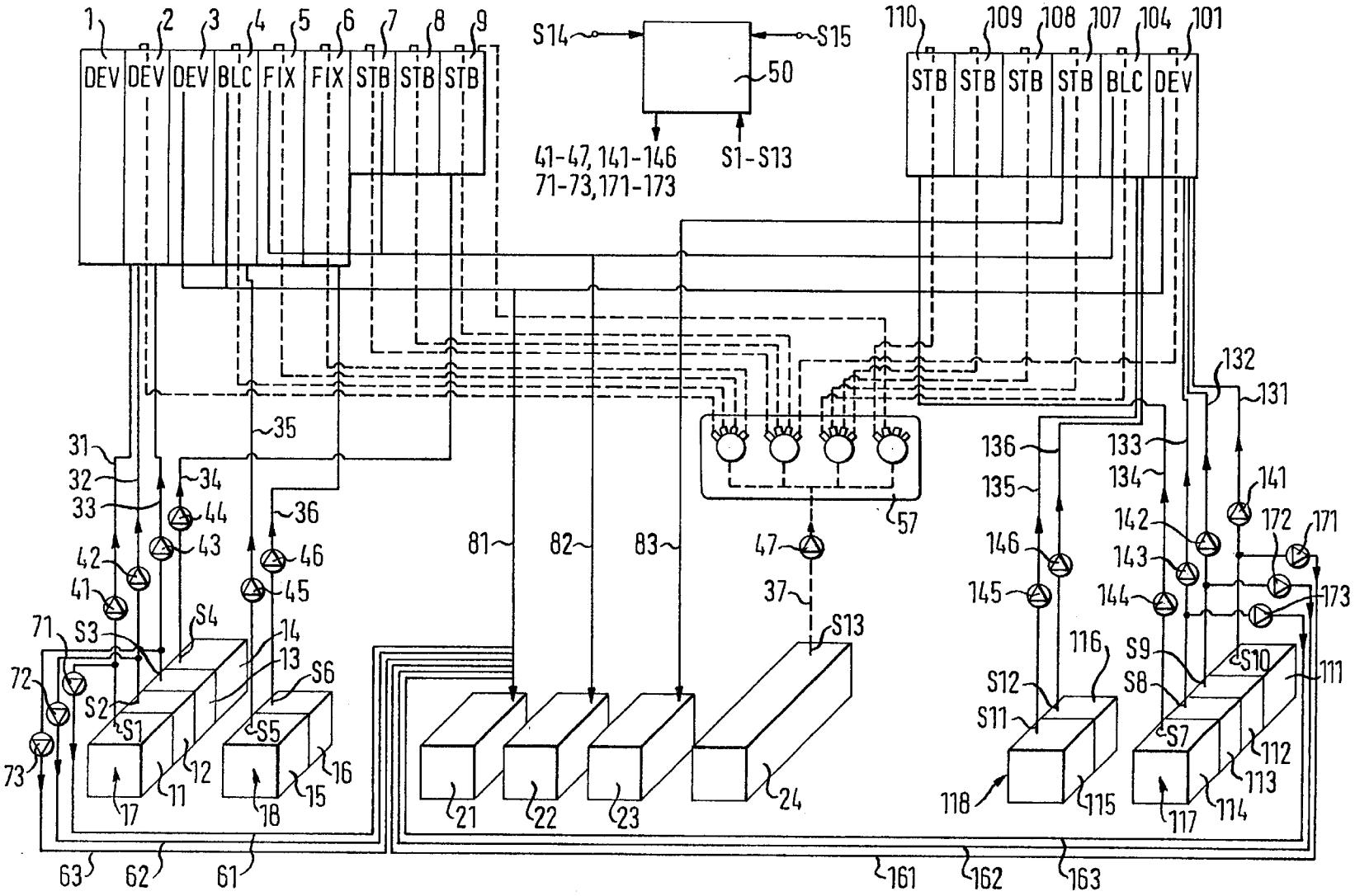
DEV
DEV
DEV
BLC
FIX
FIX
STB
STB
STB
STB
STB
STB
BLC
DEV
S1-S13
41-47, 141-146
71-73, 171-173
S1
S2
S3
S4
S5
S6
S7
S8
S9
S10
S11
S12
S13
S14
S15

DEVICE FOR THE WET CHEMICAL PROCESSING OF PHOTOGRAPHIC MATERIAL

CROSS-REFERENCE TO RELATED APPLICATIONS

This application is a continuation application under 35 U.S.C. §120 of PCT/EP00/02824 entitled, "Device For The Wet Chemical Processing Of Photographic Material", designating the United States, filed Mar. 30, 2000, which is incorporated herein by reference.

BACKGROUND

1. Field of the Invention

The invention relates to a device for the wet chemical processing of photographic material.

2. Background Art

Photographic processing devices of this type are generally referred to as processors (film processors, paper processors). In many photofinishing apparatus, especially so-called minilabs, both a film as well as a paper processor are present.

Such a processor includes a series of treatment tanks through which the photographic material to be processed, film or paper, is sequentially guided. Typically, one or more developing tanks, a bleaching tank, one or more fixing tanks and one or more stabilizer tanks are provided, in which developer solutions, bleaching solutions, fixing solutions and stabilizing solutions are found during operation, whereby these treatment solutions are adapted to the photographic material to be processed. The number of tanks can vary depending on the material and the associated chemical system and one or more developing and fixing tanks are present in each case.

The treatment solutions in the treatment tanks are used up depending on the material throughput and must therefore be replenished either continuously or on demand. Exchangeable storage containers for the individually required treatment solutions are provided for this purpose in the processor, which are connected with the treatment tanks through a system of pumps and conduits. A control for the pumps ensures that the treatment solutions in the individual treatment tanks are replenished from the storage containers as required.

Of course, empty storage containers must be replaced in time by full-size containers, which requires a certain maintenance effort. For ease of use and simplification of the manipulation of the storage containers, a concept was recently introduced in which all treatment solutions required for a certain wet chemical treatment system are provided in plastic containers, whereby those plastic containers in turn are found in two packaging cartons. Typically, one packaging carton includes the containers for three developing solutions and the stabilization solution, while the other packaging carton includes the container for the bleaching and fixing solution or a combined bleaching and fixing solution. The chemical system and correspondingly the use of treatment solutions, the individual plastic containers and the treatment solutions stored therein are in this concept adapted to one another in such a way that normally all plastic containers or packaging cartons are emptied simultaneously, presuming the pump output of the pumps is correspondingly adapted. Level sensors, for example in the form of electrical contacts, are provided in the plastic containers or in the packaging cartons including them, which signal to the control connected thereto when a container is empty. With this concept, the handling is essentially simplified compared to former approaches in that all storage containers can be simultaneously exchanged and therefore only the exchange of two packages is required, which include all required treatment solutions. Furthermore, the disposal of the empty packages is very easy, since they should no longer include any significant amounts of treatment solution and can therefore be easily separated into plastic and cardboard.

However, this concept in practice is still associated with difficulties from time to time. Because of insufficient precision of the pumps used and because of the variation from packaging carton to packaging carton of the vacuum required for the removal of the treatment solutions from the containers, it very often occurs that not all containers are emptied at the same time. However, as soon as one container is empty, all other containers or packages must also be replaced according to this concept. Apart from the waste of unused treatment solutions, the disposal of the packages is however also rendered significantly more difficult and expensive because of their environmentally dangerous content. Furthermore, the treatment solutions in the processing tanks are not correctly refilled which can have a negative effect on the treatment process.

SUMMARY OF THE INVENTION

It is now an object of the invention to overcome this difficulty and to improve a processing device of the generic type in such a way that the storage containers for the individual treatment solutions can be more easily and cheaply disposed of.

This object is now achieved with a processing device in accordance with the invention which in addition to the conventional components further includes an additional pump controlled by the control and an additional conduit for each of at least those storage containers including photographic developing solution. The control and the additional pumps are constructed for pumping the treatment solution out of those storage containers when one of the level sensors indicates that the associated storage container is empty.

BRIEF DESCRIPTION OF THE DRAWING

The invention will be further described in the following by way of example only and with reference to the single drawing which illustrates a schematic view of the combination of a film processor and a paper processor which are each respectively constructed as a treatment device in accordance with the invention, but have several common components (which are insignificant for the invention).

DETAILED DESCRIPTION OF THE PREFERRED EMBODIMENT

The conventional components of the film processor and those in accordance with the invention are shown on the left side of the drawing and the conventional components of the paper processor and those in accordance with the invention are shown on the right side. The components illustrated in the middle of the drawing are common to both processors.

The film processor includes three developing tanks 1, 2, 3, a bleaching tank 4, two fixing tanks 5, 6 and three stabilizing tanks 7, 8, 9. During operation, these 9 treatment tanks include a developer solution, a bleaching solution, a fixing solution and a stabilizing solution for the generally conventional wet chemical processing of photographic film material.

Similarly, the paper processor includes a developer tank 101, a bleaching/fixing tank 104 and four stabilizer tanks

107, 108, 109, 110. These treatment tanks include during operation a developer solution, a combined bleaching and fixing solution and a stabilizer solution for the generally conventional wet chemical treatment on photographic copy material (copier paper).

The photographic material, film or copier paper to be treated is sequentially guided in a generally conventional manner respectively starting with a developer tank through the different treatment tanks and thereby subjected to the wet chemical treatment. The treatment solutions used and the number of the treatment tanks are normally different for film and paper. The manner of the chemical treatment (the type of treatment chemistry) and the manner of the transport of the photographic material through the tanks are not the subject of the invention and therefore need not be further described.

Six plastic storage containers 11–16 are present in the film processor for the refilling of the treatment tanks which are combined into two packages 17 and 18 by way of two cardboard over containers. In the same manner, six plastic storage containers 111–116 are provided in the paper processor which are also combined into two packages 117 and 118 by way of two cardboard over containers. Respectively, one package 17 or 117 includes three storage containers 11 to 14 or 111–114 for developing solution and stabilizing solution, while the other package 18 or 118 respectively includes the storage containers 15 and 16 or 115 and 116 for the bleaching solution and the fixing solution (film) or the combined bleaching and fixing solution (paper). Each storage container 11–16 or 111–116 is provided with a level sensor as S1–S12, which indicates to a control 50 connected therewith whether or not the respective storage container is empty. The storage container and the packages are conventional and correspond to the above described concept.

Four further containers 21–24 are common to both processors, of which the containers 21–23 serve as collecting containers and the container 24 forms a water tank and is also provided with a level sensor S13 connected with the control 50.

The storage container 11–16 or 111–116 and the collecting containers 21–23 as well as the water tank 24 are connected with the treatment tanks 1–9 or 101–110 through two systems of refill conduits 31–37 or 131–136, and a system of overflow conduits 81–83. The three conduit systems are thereby constructed in a generally known manner in such a way that the individual treatment tanks are respectively connected through the refill conduits with the corresponding storage containers and that on the other hand the overflow conduits drain from the bleaching tanks, the fixing tanks and the stabilizing tanks into the collecting containers 22 and 23, so that a separation into silver containing and non silver containing solutions is possible. Since the stabilizing tanks generally include only weak silver containing solutions, their overflow conduits can also be guided into the collecting container 21. Alternatively, the overflow conduits can also be guided in such a way that strongly silver containing solutions are guided, for example, into the collecting container 22 and weak silver containing solutions into the collecting container 23. The refill conduit 37 shown in broken lines connects the water tank 24 through a distributor member 57 with all treatment tanks, whereby the branch conduits leading from the distributor member to the treatment tanks are also illustrated in broken lines.

The refill conduits 31–36 and 131–136 are removeably connected in a generally known manner through quick couplings with the storage containers 11–16 or 111–116. In this manner, the storage containers can be easily and comfortably connected with the conduits or disconnected therefrom.

Electrical refill pumps 41–46 or 141–146 and 47 which are connected with the control 50 and operated thereby are provided in the refill conduits 31–36 and 131–136 as well as in the refill conduit 37. Under the control of the control 50, the required amounts of treatment solution or water are refilled into the individual treatment tanks by way of these refill pumps from the individual storage containers 11–16 or 111–116 and from the water tank 24 through the refill conduits 31–36 and 131–136 as well as 37. The refill process is thereby stopped when one of the level sensors S1–S6 or S7–S12 reports that the storage container associated therewith is empty. The two packages 17 and 18 with the six storage containers 11–16 of the film processor or the two packages 117 and 118 with the six storage containers 111–116 of the paper processor are subsequently exchanged with corresponding full packages or storage containers.

The film processor and the paper processor illustrated in the figure in-so-far completely correspond in construction and function to the prior art so that a further description is obviated for a person skilled in the art. The differences in accordance with the invention to conventional treatment devices are discussed in the following.

According to an important object of the invention, those storage containers 11–14 or 111–113 which include developer solution are respectively provided with one additional conduit 61–63 or 161–163, whereby in each additional conduit an additional pump 71–73 or 171–173 is provided, which is connected with the control 50 and operated thereby. The additional conduits 61–63 or 161–163 are connected to those portions of the refill conduits 31–33 or 131–133 which are located between the refill pumps 41–43 or 141–143 and the storage containers 11–13 or 111–113, which means on the suction side of the refill pumps, and lead to the collecting container 21 for non silver containing solutions. These additional pumps serve first of all for the pumping, if required, of residual amounts of treatment solution out of the developer solution storage containers so as to completely empty the storage containers. It is a further function of these additional pumps to suck off air, which, during the changing of the packages or the storage containers, may have entered into the portions lying between the refill pumps and the storage containers, so that the pumping precision of the refill pumps is not impaired.

When the control 50 receives a signal from one of the level sensors S1–S12 that the storage container associated therewith is empty, the control first carries out a plausibility test. It is therefor connected with the two symbolically illustrated generally known material sensors S14 or S15 which capture the amounts of the treated photographic material which has passed through the treatment tanks of the film processor or the paper processor since the last exchange of the storage containers. When the captured material amount (film or paper amount) lies below a nominal amount preset for the packages or the storage containers by not more than a present tolerance value, it is assumed that the corresponding storage container is indeed empty and the further steps are then initiated. Otherwise, an error situation is assumed and a corresponding interaction by an operator is requested.

Next, all remaining amounts of treatment solution possibly still present in the storage containers are pumped out. The less critical bleaching, fixing and stabilizing solutions are thereby under the control of the control 50 pumped into the corresponding treatment tanks 4–9 or 104–110 by way of the refill pumps 44–46 or 144–146. The remaining amounts of developer solution in the storage containers 11–13 or 111–113 are however also, again under the control of the control 50, pumped off by way of the additional pumps 71–73 or 171–173 into the collecting container 21 for non silver containing solutions. Alternatively, a certain portion (a certain percentage of the developer tank volume) of these residual amounts of developer solutions can initially be pumped into the corresponding developer tanks and the remaining portion pumped into the collecting container.

When all storage containers are completely emptied in this manner, the packages or the storage containers can be removed from the film processor or the paper processor and replaced by corresponding full storage containers. Before operation is resumed, the additional pumps 71–73 or 171–173 are first operated under the control 50 for a short time in order to suck off air which has possibly entered the refill conduits.

In the above described embodiment, additional conduits and corresponding additional pumps are only assigned to the storage containers including developer solution. It is readily apparent that additional conduits and additional pumps can also be provided for the remaining storage containers, for example to pump off residual amounts of treatment solution into the collecting container 21 instead of into the corresponding treatment tanks or to suck off air bubbles from the refill conduits. It is further apparent that the remaining amounts can also be pumped into suitable intermediate containers from which they can then be guided to a further use, if desired.

According to an especially preferred embodiment of the invention, the refill pumps 31–36 or 131–136 are constructed in a generally known manner in such a way that their output (pumped volume per unit of time) is controllable by the control 50. The control 50 is thereby provided with a program routing which determines a correction value for the adjustment of the outputs of the individual refill pumps on the basis of the residual amounts pumped off from the individual storage containers and correspondingly correct the output adjustments so that the residual amounts in the subsequently used storage containers are 0 or at least smaller, so that the storage containers thereby become empty all essentially at the same time. The refill pumps and the control controlling them are therefore to some degree self-teaching. It is understood that such a correction of the pump outputs is sensibly derived not from the residual amounts of a single set of storage containers but from a statistical evaluation of the residual amounts of a large number of storage containers sets.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Device for the wet chemical processing of photographic material, comprising: multiple treatment tanks through which photographic material to be treated is sequentially moved and which contain, during operation, photographic treatment solutions;

multiple treatment solution storage tanks including corresponding treatment solutions;

a water tank;

a refill pump and refill conduit for each storage tank and the water tank, for pumping treatment solutions and water from the storage containers into the corresponding treatment tanks and water tank a level sensor associated with each storage tank;

a control for the refill pumps for stopping the refill pumps when one of the storage tanks is empty as indicated by the associated level sensor; and an additional pump controlled by the control and an additional conduit provided for each of at least those storage containers including photographic developing solution as a treatment solution, for pumping the treatment solution out of those storage containers.

2. Device according to claim 1, wherein the treatment solutions are developing, bleaching, fixing and stabilizing solutions.

3. Device according to claim 1, wherein the control operates the refill pumps and the additional pump such that after emptying one of the storage containers any residual amount of treatment solution in another storage container is pumped off.

4. Device according to claim 3, wherein the control is constructed for operating the refill pumps to empty those storage containers containing solutions other than photographic developer solution into corresponding ones of the treatment tanks.

5. Device according to claim 3, wherein the additional conduit leads to a collecting container and the control is constructed for operating the additional pump to empty photographic developing solution from the storage containers into the collecting container.

6. Device according to claim 3, wherein the additional conduit leads to a collecting container and the control is constructed for operating the refill pumps to empty photographic developing solution from the storage containers by pumping part of any residual amount of the photographic developing solution into corresponding treatment tanks and any remainder into the collecting container.

7. Device according to claim 3, wherein the additional conduits lead to separate intermediate containers from which the residual amount is drained.

8. Device according to claim 3, wherein the additional pumps are connected to the refill conduits upstream of the refill pumps.

9. Device according to claim 8, wherein the control is constructed for operating the additional pumps for a short time after connection of full storage containers, to suck off air bubbles from portions of refill conduits upstream of the refill pumps.

10. Device according to claim 3, comprising:

a material sensor cooperating with the control for sensing photographic material treated since connection of full storage containers, wherein the control is constructed for initiating pumping empty the storage containers when the photographic material is not by more than a preselected tolerance value below a preselected nominal amount.

11. Device according to claim 3, wherein the output of the refill pumps is adjustable by way of the control and the control is constructed for adjusting outputs of the refill pumps based on residual amounts of treatment solutions pumped out of the storage containers, so that the residual amounts in subsequently connected storage containers tend toward 0.

* * * * *